US011262053B2

(12) United States Patent
Huang et al.

(10) Patent No.: US 11,262,053 B2
(45) Date of Patent: Mar. 1, 2022

(54) LIGHT PLATFORM APPARATUS

(71) Applicant: XIAMEN ECO LIGHTING CO. LTD., Xiamen (CN)

(72) Inventors: Huiyong Huang, Xiamen (CN); Zhenyu Tang, Xiamen (CN); Shuxing Gao, Xiamen (CN); Edwin T Mackiewicz, Fayetteville, GA (US)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/899,080

(22) Filed: Jun. 11, 2020

(65) Prior Publication Data

US 2021/0156550 A1 May 27, 2021

(30) Foreign Application Priority Data

Nov. 22, 2019 (CN) ..... 201922042069.1
Nov. 22, 2019 (CN) ..... 201922044155.6

(51) Int. Cl.
*F21V 21/088* (2006.01)
*F21V 21/34* (2006.01)
*F21V 29/508* (2015.01)

(52) U.S. Cl.
CPC ..... *F21V 21/088* (2013.01); *F21V 21/34* (2013.01); *F21V 29/508* (2015.01)

(58) Field of Classification Search
CPC .. F21S 8/026; F21S 8/02; F21V 21/04; F21V 23/026; F21V 29/713
See application file for complete search history.

(56) References Cited

U.S. PATENT DOCUMENTS 5,588,737 A * 12/1996 Kusmer ..... F21V 19/0005 174/660
5,857,766 A * 1/1999 Sieczkowski ..... F21S 8/026 362/365
10,502,404 B1 * 12/2019 Bowen ..... F21V 23/008
2019/0017688 A1 * 1/2019 Morales ..... H05B 45/00

* cited by examiner

*Primary Examiner* — William J Carter
(74) *Attorney, Agent, or Firm* — Chun-Ming Shih; Lanway IPR Services

(57) ABSTRACT

A light platform apparatus is provided for installing a light device. The light platform apparatus includes an installation plate and a guiding unit. The installation plate has a light device area on an inner side of the installation plate for mounting the light device. The installation plate has a light escape corresponding to a light opening of the light device. A light output from the light opening of the light device passes through the light escape to an outer side of the installation plate main body. The guiding unit is corresponding to a fixing unit. The fixing unit is extended from the bottom edge of the driver box outwardly. The guiding unit provides a sliding path for the fixing unit to slide in and then keeps the fixing unit fixed to the guiding unit for fixing the driver box to the installation plate.

18 Claims, 7 Drawing Sheets

LIGHT PLATFORM APPARATUS

FIELD

The present application is related to a light platform apparatus and more particularly related to a light platform for installing a light device.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

Even now, light bulbs are popular in various applications and places. When incandescent lights are replaced, not only luminance functions, but also visual effects need to be considered. To ensure such effects, factors need to be considered to design a reliable light bulb. It is beneficial to take such challenge, particularly when needs of light bulb devices are still strong and will be in the near future.

It is important to find a way to install light devices. Usually, people need to find professional people to help them install light devices. If there is a tool or a platform for easily installing light devices, it would help improve human life. Particularly, if such platform is flexible and with low cost, it would be even better to broadcast such technology around the world.

SUMMARY

In some embodiments, a light platform apparatus is provided for installing a light device. The light platform apparatus includes an installation plate and a guiding unit.

The installation plate has a light device area on an inner side of the installation plate for mounting the light device. The installation plate has a light escape corresponding to a light opening of the light device. A light output from the light opening of the light device passes through the light escape to an outer side of the installation plate main body.

The guiding unit is corresponding to a fixing unit. The fixing unit is attached to a bottom edge of the driver box. The fixing unit is extended from the bottom edge of the driver box outwardly. The driver box provides a driving current to the light device. The guiding unit provides a sliding path for the fixing unit to slide in and then keeps the fixing unit fixed to the guiding unit for fixing the driver box to the installation plate.

In some embodiments, the light escape is manually adjustable to select an escape diameter of the light escape from multiple diameter options for fitting to an opening diameter of the light opening of the light device.

In some embodiments, the multiple diameter options correspond to multiple concentric geometric rings with different ring diameters.

In some embodiments, the guiding unit has a warped part, a buckle part, a main body plate and a connecting part. The warped part engages the fixing unit and moves for allowing the fixing unit entering a hook area. When the fixing unit enters the hook area, the fixing unit is kept at the hook area by the buckle part and the main body plate. The buckle part and the main body plate together form the hook area. The connecting part is fixed to the installation plate.

In some embodiments, the fixing unit have a first fixing part and a second fixing part attached on two opposite sides of the driver box.

In some embodiments, the fixing unit has a protruding block protruding from a flat plate. The protruding block is kept in the hook area clipping by the buckle part and the main body plate.

In some embodiments, the light platform apparatus may also include two fixing blocks on two sides of the connecting part for preventing the guiding unit to rotate from the connecting part.

In some embodiments, the installation plate has a main body plate and an adjusting folding plate. The adjusting folding plate is foldable to change a horizontal length of the installation plate to fit to a different installation gap.

In some embodiments, there are multiple options for folding the adjusting plate with different horizontal lengths of the installation plate.

In some embodiments, the adjusting folding plate is fixed to a vertical wall surface.

In some embodiments, the adjusting folding plate has a hook structure hooking to an associated fastener fixed on the vertical wall.

In some embodiments, there are multiple folding holes disposed between the main body plate and the adjusting folding plate.

In some embodiments, a protruding bottom edge is extended outwardly from a connection position between the main body plate and the adjusting folding plate. The protruding bottom edge is perpendicularly disposed with respect to the adjusting folding plate.

In some embodiments, in a first installation mode, the main body plate is co-plane with the adjusting folding plate to be installed. In a second installation mode, the main body plate is perpendicular to the adjusting folding plate to be installed.

In some embodiments, a conductive path is disposed on the installation plate for electrically connecting the light device and the driver box.

In some embodiments, the conductive path of the installation is connected to a terminal connecting to another installation plate for sharing electricity from the driver box to the another installation plate.

In some embodiments, the installation plate has multiple function module slots for inserting function modules getting power from the driver box.

In some embodiments, the light platform apparatus may also include a buckling structure for fixing the light device on the installation plate. The buckling structure provides an electric connection to the driver box.

In some embodiments, the installation plate is made of a metal plate stamping for producing a main body plate and an adjusting folding part. The adjusting folding part is foldable with respect to the main body plate to change a horizontal length of the installation plate.

In some embodiments, the light device transmits heat to the installation plate with a heat dissipation strip heat conductive to a first heat dissipation area of the installation plate. The first heat dissipation area is heat insulated from a second heat dissipation area of the installation plate for dissipating heat of the driver box.

DETAILED DESCRIPTION

Figure 1:
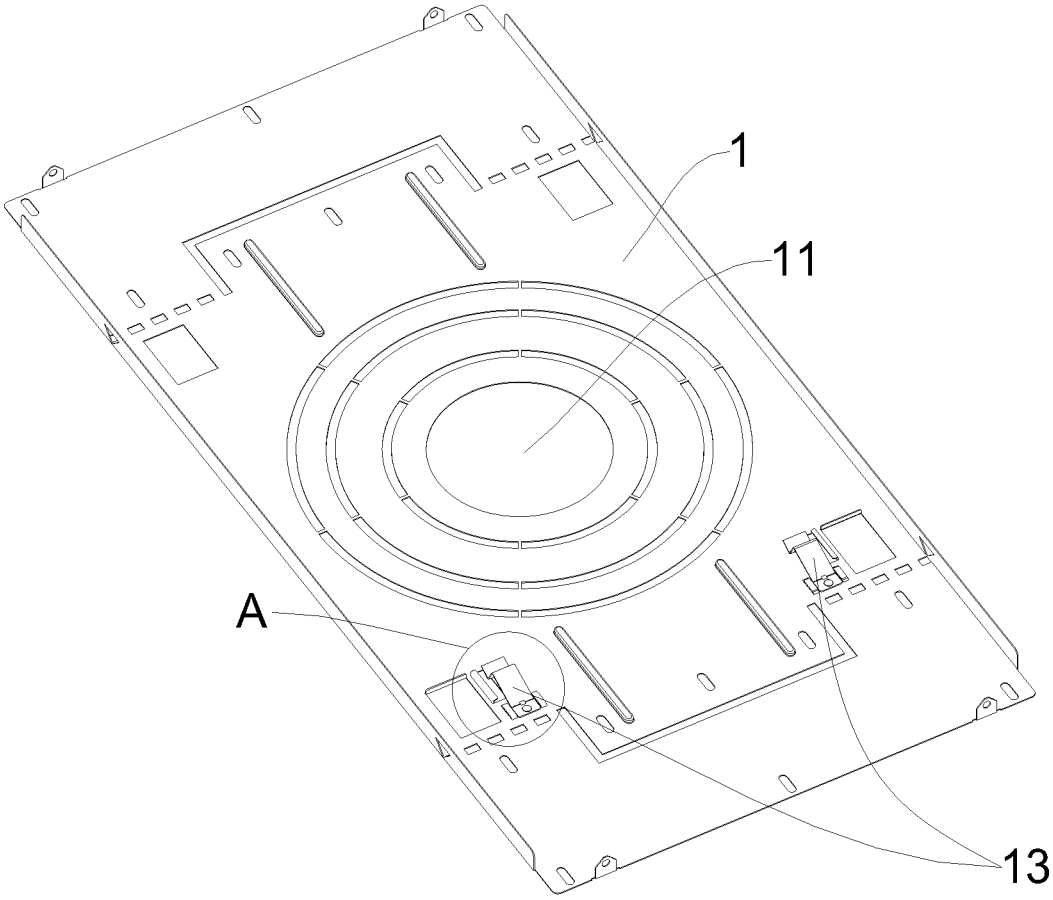
FIG. 1 illustrates an embodiment of a light platform apparatus.
Figure 2:
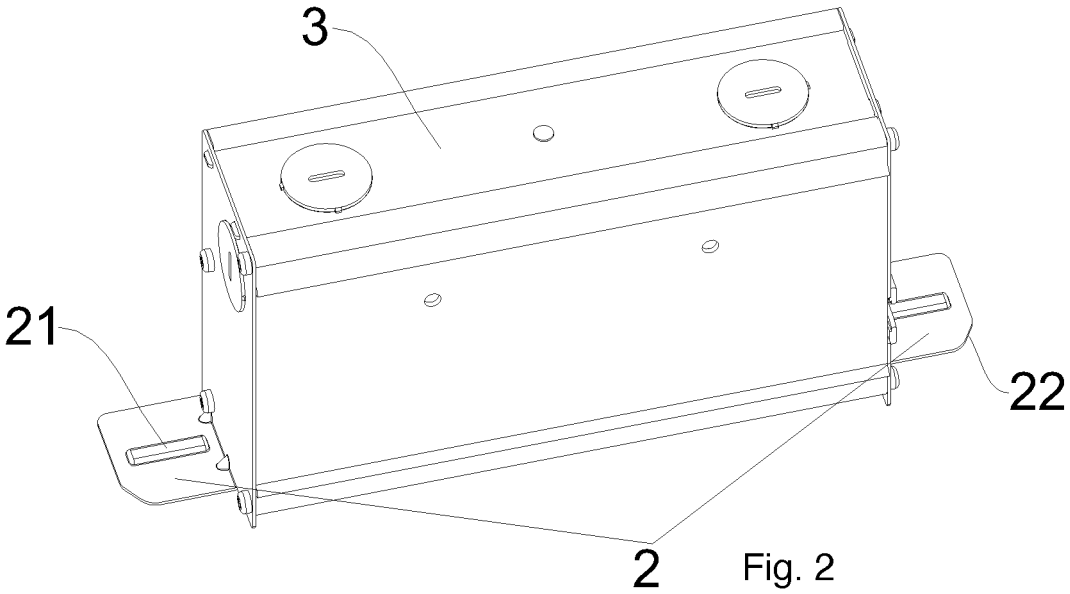
FIG. 2 illustrates an embodiment of a driver box.
Figure 3:
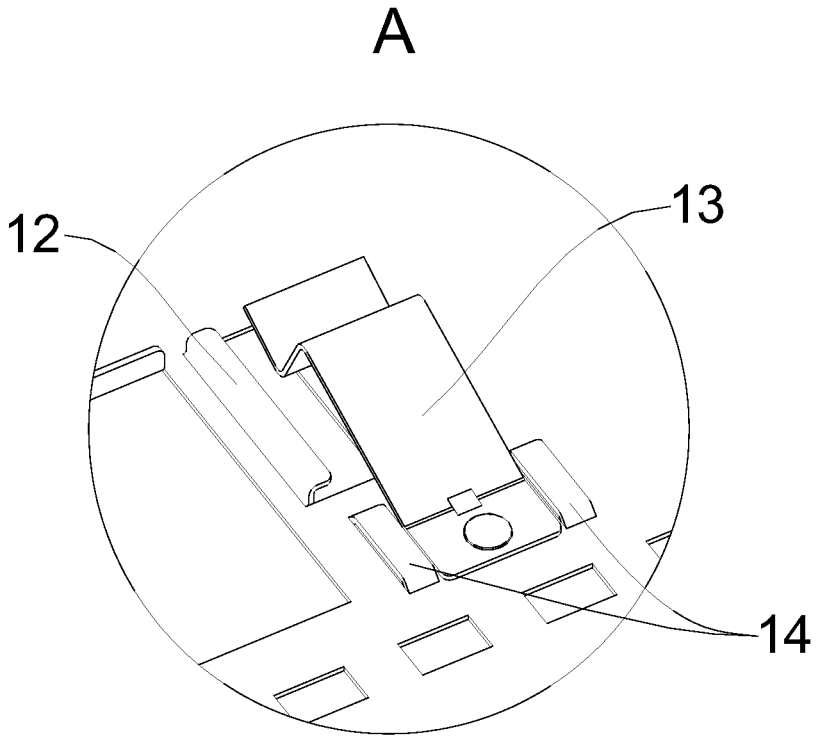
FIG. 3 illustrates a zoom-up view of a component.

Please refer to FIG. 1 to FIG. 3. In the examples of FIG. 1 to FIG. 3, a light platform apparatus is designed for installing a light device.

The light platform apparatus includes an installation plate 1 and a fixing unit 2. The installation plate 1 has an installation hole 11. There is a driver holder area for placing a driver module 3, which in this example is made of a driver box style.

There is a guiding unit 12 on the driver holder area. The guiding unit 12 has an elastic pressing fastener 13. One end of the elastic pressing fastener 13 is fixed to the installation plate 1. Another end of the elastic pressing fastener 13 is an active end that can be moved.

The fixing unit 2 has a first fixing part and a second fixing part disposed on two opposite sides of the driver module 3. The fixing unit 2 is slided into and buckled to fix to the guiding unit 12 via a sliding path of the guiding unit 12. When the fixing unit 2 is manually pushed toward the elastic pressing fastener 13, the fixing unit 2 lifts the active end of the elastic pressing fastener 13 with an elastic deformation. The fixing unit 2 then enters a hook area and is clipped by the elastic pressing fastener 13 to be fixed to the guiding unit 12.

Such design provides a convenient installation structure for the driver module. Specifically, the blind operation only relies on aligning the fixing unit 2 to the guiding unit 12. After the alignment, users only need to push the driver module 3 to complete the installation of the driver module 3. No screws or welding is necessary and user experience is greatly enhanced.

In this example, the fixing unit 2 is attached to a bottom edge of the driver module 3 and extends from the bottom edge of the driver module 3 outwardly. The driver module 3 provides a driving current to the light device.

Figure 4:
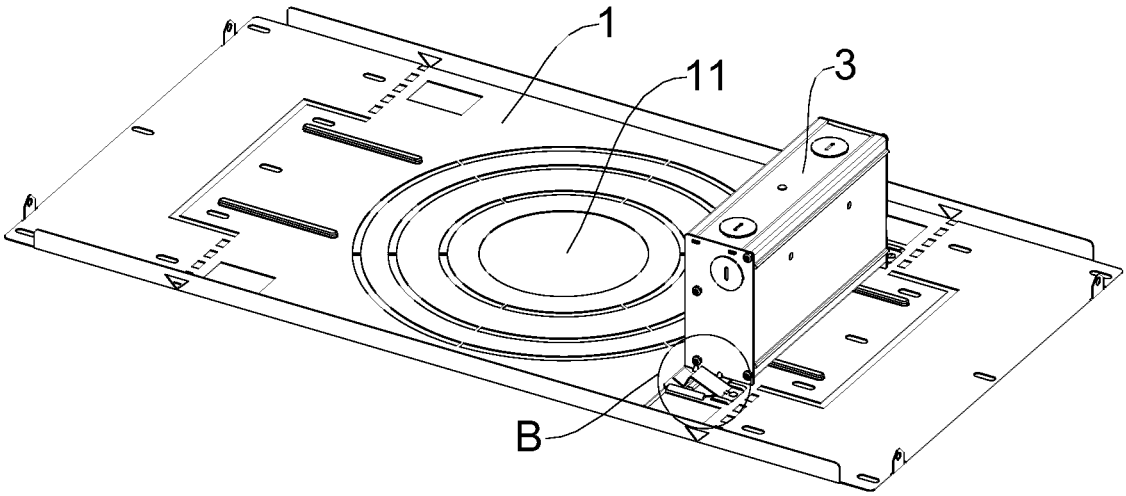
FIG. 4 illustrates another view of the embodiment.
Figure 5:
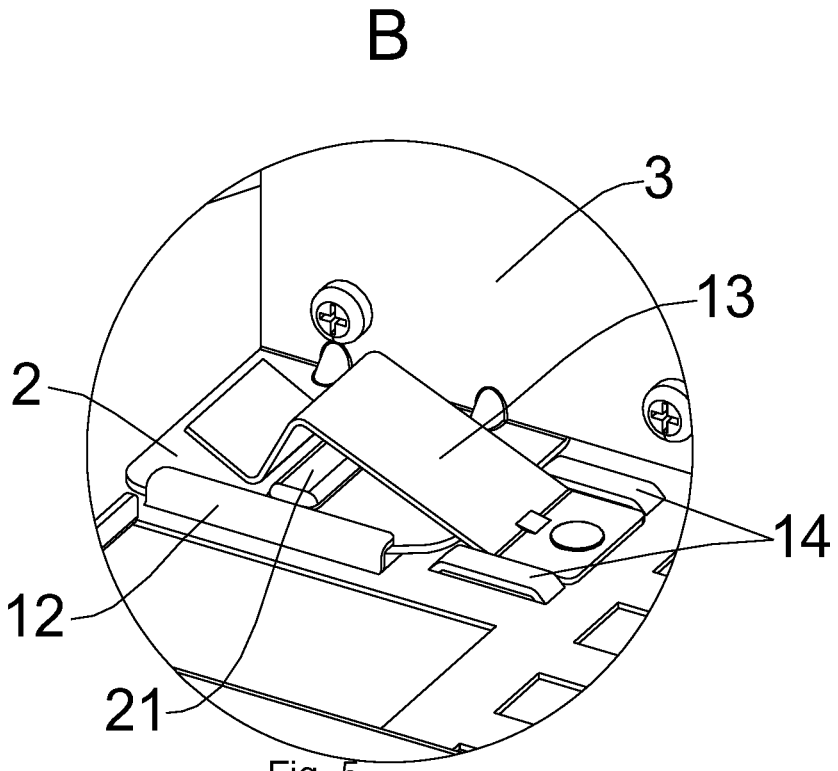
FIG. 5 illustrates a zoom-up view of a connection between components.

FIG. 4 and FIG. 5 show that the fixing unit 2 is fixed by the guiding unit 12.

When the driver 3 is slided into the driver holder area, the fixing unit 2 is sliding to be buckled to the guiding unit 12.

In FIG. 2 and FIG. 5, there is a protruding block 21. The protruding block 21 is protruded from a flat plate. The protruding block 21 is kept in the hook area of the guiding unit 12.

In some embodiments, the installation plate 1 is placed horizontally. Therefore, the driver module 3 is free of force from horizontal direction. The fixing unit 2 is fixed to the elastic pressing fastener 13.

The protruding block 21 further enhances the connection between the fixing unit 2 and the elastic pressing fastener 13. The elastic fastener 13 firmly presses the fixing unit 2 so as to keep the driver module 3 on the driver holder area of the installation plate 1.

Figure 6:
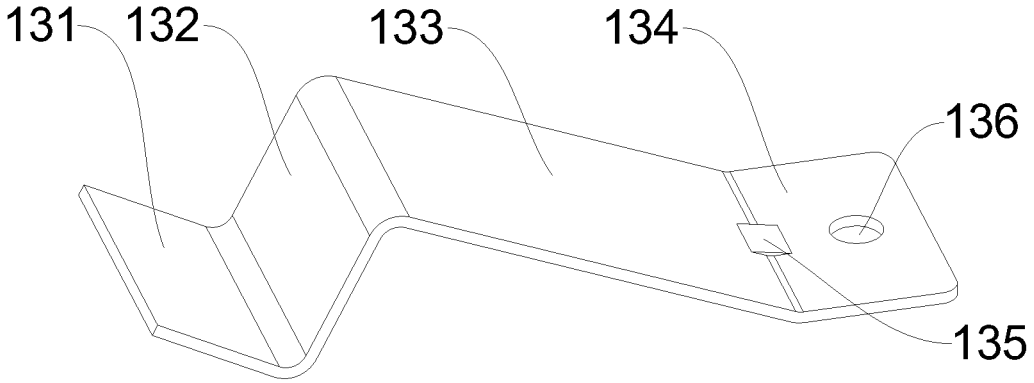
FIG. 6 illustrates an example of a guiding unit.

In FIG. 6, the elastic pressing fastener 13 has a warped part 131, a buckle part 132, a main body plate 133 and a connecting part 134. The connecting part 134 is fixed to the installation plate 1. The warped part 131 is at the active end of the elastic pressing fastener 13. In this example, the elastic pressing fastener 13 has a folded plate structure.

The warped part 131 is lifted by the fixing unit 2 and the protruding block 21 when the fixing unit 2 is slided into the elastic pressing fastener 13.

The buckle part 132 and the warped part 131 has an intersection angle forming a V structure. The connection end between the buckle part 132 and the warped part 131 is used for pressing the fixing unit 2.

There is an intersection angle between the main body plate 133 and the buckle part 132, forming an inverted V structure that defines a hook area. The protruding block 21 is moved into the hook area.

Figure 7:
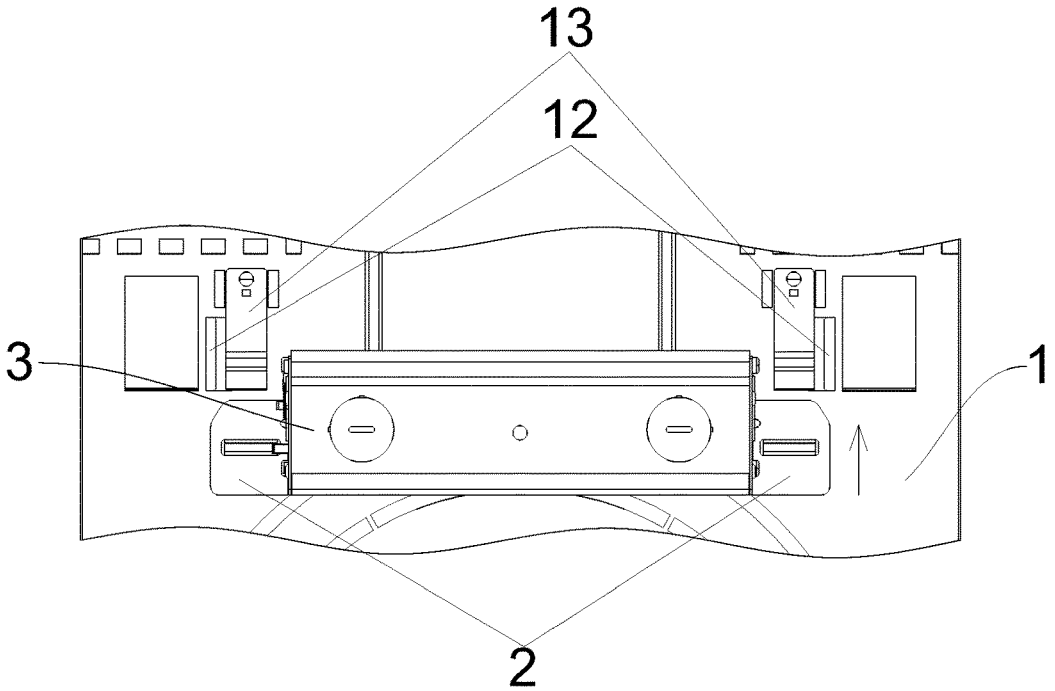
FIG. 7 illustrates an installation status.

In FIG. 7, the driver module 3 is moved and slided along a direction marked by the arrow to install the driver module 3 to the installation plate.

In the example, there is a strengthen block 135 at a top surface of the connection between the main body plate 133 and the connecting part 134 for enhancing connection strength between the main body plate 133 and the connecting part 134.

There is a connection hole 136 on the connecting part 134 to use rivet or screw to fix the elastic pressing fastener to the installation plate 1, as shown in FIG. 3 and FIG. 5.

There are two fixing blocks 14 on the installation plate 1 for preventing the elastic pressing fastener of the guiding unit to rotate from the connecting part.

In FIG. 7, there are two elastic pressing fasteners 13 and two fixing units 2.

The fixing unit 2 has an exterior edge corner with a inverted corner 22 as shown in FIG. 2.

Figure 8:
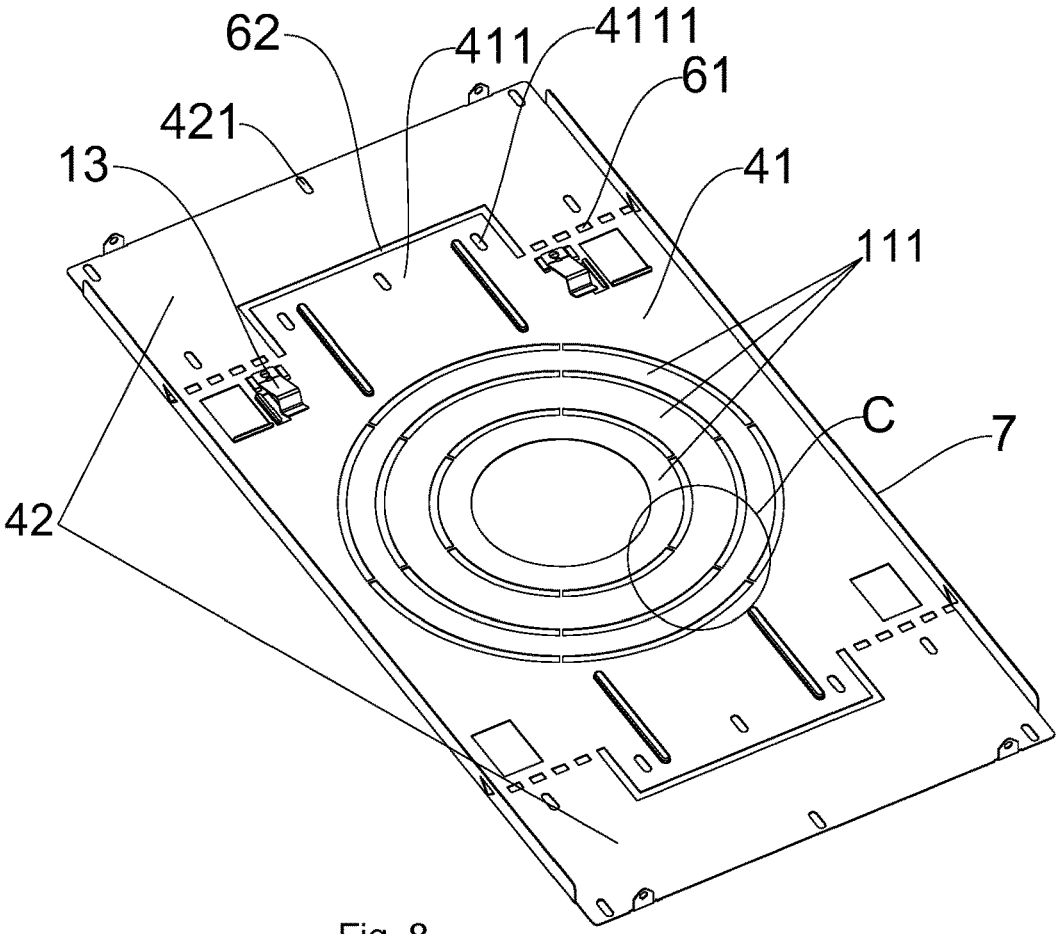
FIG. 8 illustrates an installation plate example.

In FIG. 8, the installation plate 1 includes a main body plate 41 and two adjusting folding plates 42. The installation hole 11 and the driver holder area are disposed on the main body plate 41. The adjusting folding plate is foldable to change a horizontal length of the installation plate to fit to a different installation gaps, like the examples in FIG. 9, FIG. 10 and FIG. 11.

The adjusting folding plate 42 is folded from the folding structure that is located between the connection of the adjusting folding plate 42 and the main body plate 41.

The adjusting folding plate 42 uses the folding structure to keep the adjusting folding plate to co-planed with the main body plate 41 or perpendicular to the main body plate 41.

Figure 9:
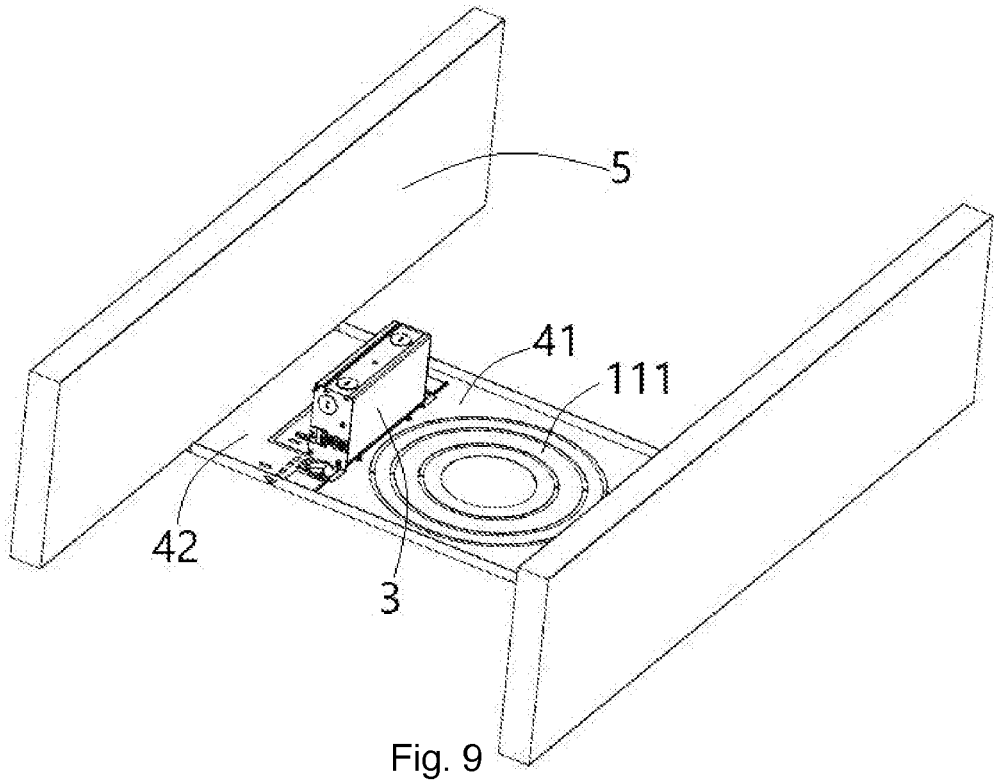
FIG. 9 illustrates a first installation setting.
Figure 11:
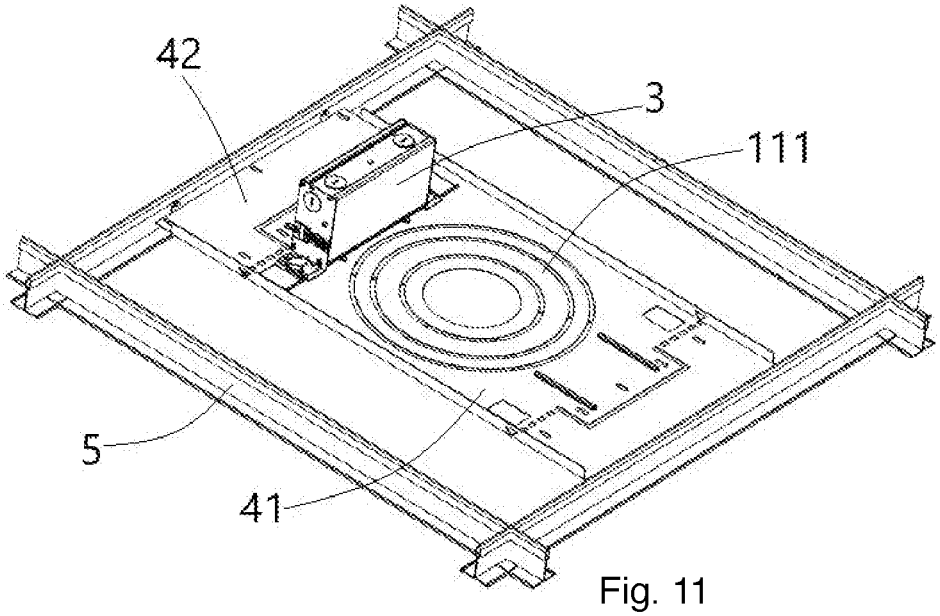
FIG. 11 illustrates a third installation setting.

When the adjusting folding plate 42 is not folded with respect to the main body plate 41, the horizontal length of the installation plate is larger to fit to a larger installation gap like the example shown in FIG. 9 and FIG. 11.

Figure 10:
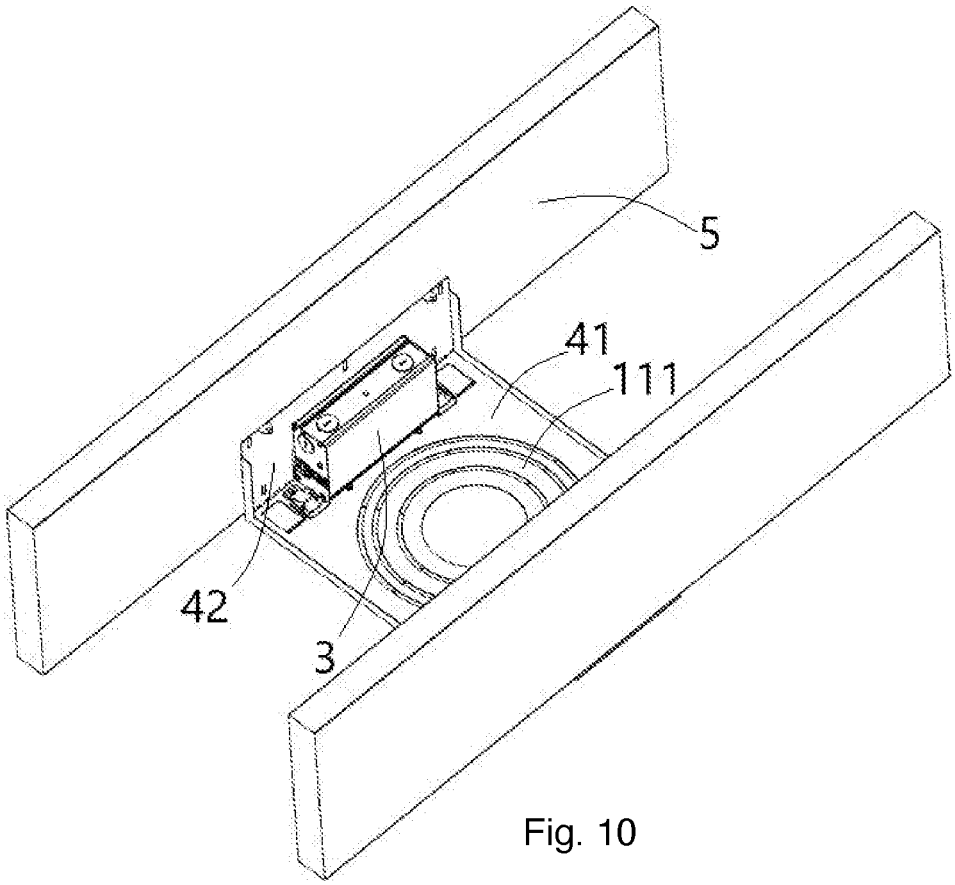
FIG. 10 illustrates a second installation setting.

There may be multiple options for folding the adjusting plate with different horizontal lengths of the installation plate. FIG. 9 and FIG. 10 show an example with different folding options. Specifically, the folding structure may include multiple rows of folding holes for guiding users to fold along one of the rows of folding holes to choose a desired horizontal length by folding.

In FIG. 10, the adjusting folding plate 42 is folded and kept perpendicular to the main body plate 41.

When the adjusting folding plate 42 is folded, there are multiple installation holes 521 that may be used for fixing to keel 5 or vertical wall surface with screws. In some embodiments, the adjusting folding plate has a hook structure, like a protruding hook or a hook hole like the example of the installation hole 521 so as to conveniently fix the installation plate to a wall or a ceiling structure.

In FIG. 8, the folding structure includes multiple folding holes 61 for easily folding the adjusting folding plate 42 with respect to the main body plate 41.

The installation plate may be made of metal material under stamping to produce necessary pattern and shape. The metal material may also be used for heat dissipation.

There is a protruding bottom edge 411 extended outwardly from a connection position between the main body plate 41 and the adjusting folding plate 42. The protruding bottom edge is perpendicularly disposed with respect to the adjusting folding plate 42 when the adjusting folding plate 42 is folded with respect to the main body plate 41. The protruding bottom edge 411 may fixed to a ceiling to enhance connection.

In FIG. 8, the protruding bottom edge 411 has multiple second installation holes 4111 for fixing the protruding bottom edge 411 to the keel 5. There is an elongated hole 62 on its edge to make it easier for folding the adjusting folding plate 42 with respect to the main body plate 41.

In FIG. 8, the installation plate has light escape for corresponding to a light opening of the light device. The light escape is manually adjustable to select an escape diameter from multiple diameter options for fitting to an opening diameter of the light opening of the light device. In FIG. 8, multiple side ring plates 111 may be selectively removed. The multiple diameter options correspond to multiple concentric geometric rings with different ring diameters. For example, such geometric ring may have circular shape, a rectangular shape, a hexagonal shape or other shape.

Figure 12:
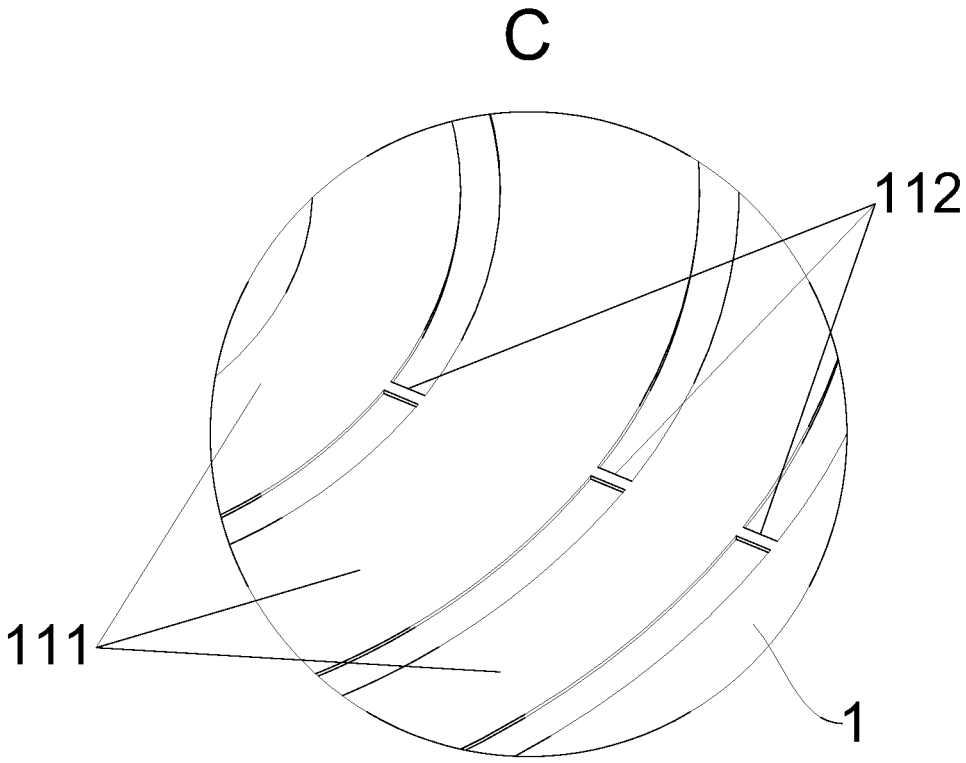
FIG. 12 illustrates a light escape that is adjustable for its dimension.

In FIG. 12, connection blocks 112 are used for connecting multiple concentric geometric rings. By breaking these connection blocks 112, the ring diameter is selected by removing unwanted rings.

In some embodiments, the ring diameter may be 4 inch, 6 inch, eight inch, or 10 inch.

In this example, there are three ring plates 111 with diameters of 8 inch, 6 inch and 4 inch. The installation hole 11 has a diameter of 10 inch.

With such design, light devices with different light opening sizes may be installed on the same installation plate by removing necessary ring plate 111. Such light device may be a downlight device or other light device.

In FIG. 8, there is a lateral folding for enhance strength and fitting the structure of the keel 5.

In some embodiments, a light platform apparatus is provided for installing a light device. The light platform apparatus includes an installation plate and a guiding unit.

The installation plate has a light device area on an inner side of the installation plate for mounting the light device. The installation plate has a light escape corresponding to a light opening of the light device. A light output from the light opening of the light device passes through the light escape to an outer side of the installation plate main body.

The guiding unit is corresponding to a fixing unit. The fixing unit is attached to a bottom edge of the driver box. The fixing unit is extended from the bottom edge of the driver box outwardly. The driver box provides a driving current to the light device. The guiding unit provides a sliding path for the fixing unit to slide in and then keeps the fixing unit fixed to the guiding unit for fixing the driver box to the installation plate.

In some embodiments, the light escape is manually adjustable to select an escape diameter of the light escape from multiple diameter options for fitting to an opening diameter of the light opening of the light device.

In some embodiments, the multiple diameter options correspond to multiple concentric geometric rings with different ring diameters.

In some embodiments, the guiding unit has a warped part, a buckle part, a main body plate and a connecting part. The warped part engages the fixing unit and moves for allowing the fixing unit entering a hook area. When the fixing unit enters the hook area, the fixing unit is kept at the hook area by the buckle part and the main body plate. The buckle part and the main body plate together form the hook area. The connecting part is fixed to the installation plate.

In some embodiments, the fixing unit have a first fixing part and a second fixing part attached on two opposite sides of the driver box.

In some embodiments, the fixing unit has a protruding block protruding from a flat plate. The protruding block is kept in the hook area clipping by the buckle part and the main body plate.

In some embodiments, the light platform apparatus may also include two fixing blocks on two sides of the connecting part for preventing the guiding unit to rotate from the connecting part.

In some embodiments, the installation plate has a main body plate and an adjusting folding plate. The adjusting folding plate is foldable to change a horizontal length of the installation plate to fit to a different installation gap.

In some embodiments, there are multiple options for folding the adjusting plate with different horizontal lengths of the installation plate.

In some embodiments, the adjusting folding plate is fixed to a vertical wall surface.

In some embodiments, the adjusting folding plate has a hook structure hooking to an associated fastener fixed on the vertical wall.

In some embodiments, there are multiple folding holes disposed between the main body plate and the adjusting folding plate.

In some embodiments, a protruding bottom edge is extended outwardly from a connection position between the main body plate and the adjusting folding plate. The protruding bottom edge is perpendicularly disposed with respect to the adjusting folding plate.

In some embodiments, in a first installation mode, the main body plate is co-plane with the adjusting folding plate to be installed. In a second installation mode, the main body plate is perpendicular to the adjusting folding plate to be installed.

Figure 13:
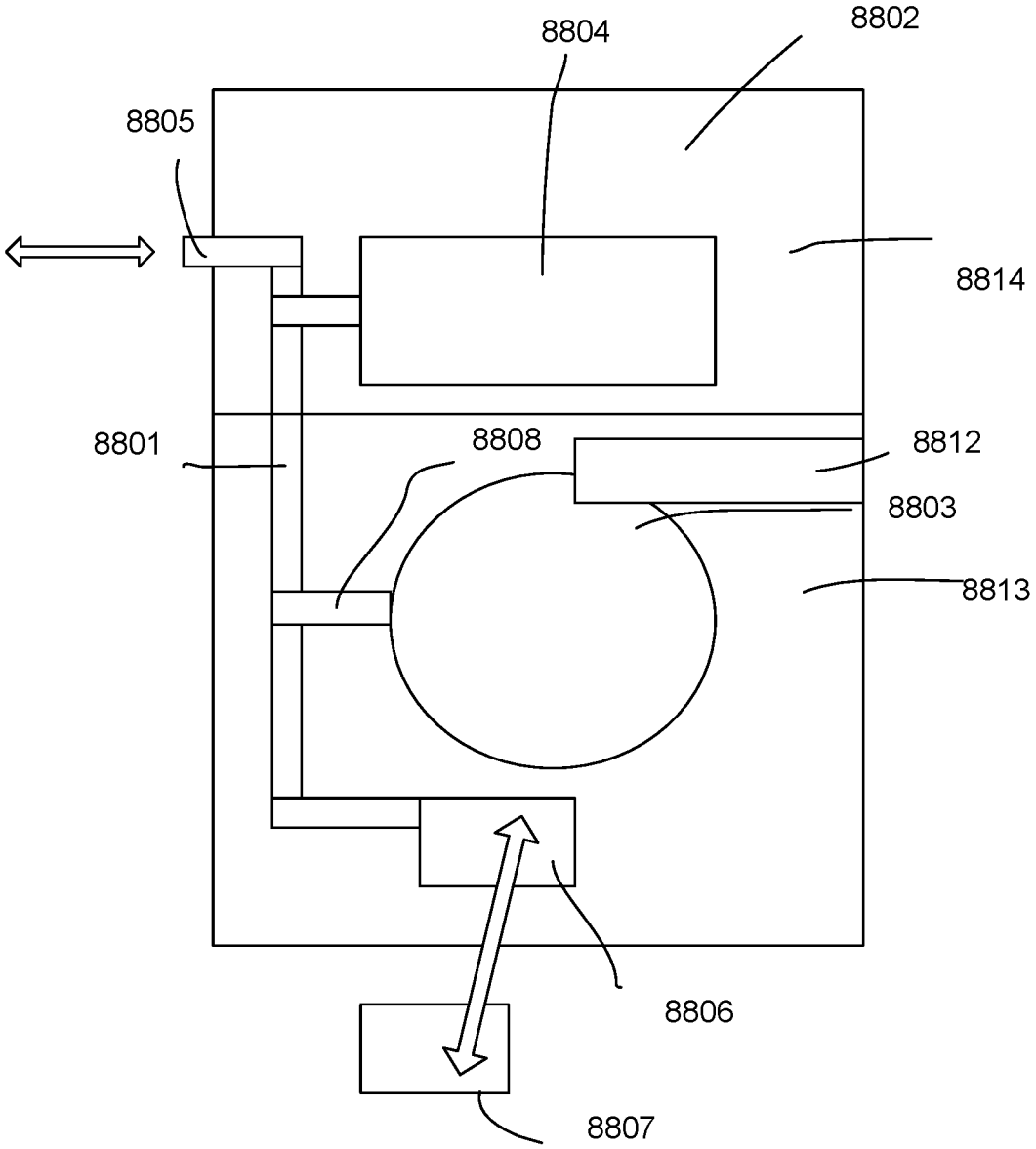
FIG. 13 illustrates an embodiment with conductive paths.

In FIG. 13, a conductive path 8801 is disposed on the installation plate 8802 for electrically connecting the light device 8803 and the driver box 8804.

In some embodiments, the conductive path 8801 of the installation is connected to a terminal 8805 connecting to another installation plate (not shown, another installation plate to be installed neighboring to the installation plate) for sharing electricity from the driver box to the another installation plate.

In some embodiments, the installation plate has multiple function module slots 8806 for inserting function modules 8807 getting power from the driver box. For example, such function module may include, but not limited to, speaker modules, wireless modules, sensor modules.

In FIG. 13, the light platform apparatus may also include a buckling structure 8808 for fixing the light device on the installation plate. The buckling structure 8808 provides an electric connection to the driver box 8804.

In some embodiments, the installation plate is made of a metal plate stamping for producing a main body plate and an adjusting folding part. The adjusting folding part is foldable with respect to the main body plate to change a horizontal length of the installation plate.

In FIG. 13, the light device transmits heat to the installation plate with a heat dissipation strip 8812 heat conductive to a first heat dissipation area 8813 of the installation plate. The first heat dissipation area 8813 is heat insulated from a second heat dissipation area 8814 of the installation plate for dissipating heat of the driver box. For example, there is heat insulation material disposed between the first heat dissipation area 8813 and the second heat dissipation area 8814.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A light platform apparatus for installing a light device, comprising:

an installation plate having a light device area on an inner side of the installation plate for mounting the light device, the installation plate having a light escape corresponding to a light opening of the light device, a light output from the light opening of the light device passing through the light escape to an outer side of the installation plate; and a guiding unit, the guiding unit corresponding to a fixing unit, the fixing unit being attached to a bottom edge of a driver box and extending from the bottom edge of the driver box outwardly, the driver box providing a driving current to the light device, the guiding unit providing a sliding path for the fixing unit to slide in and then keeping the fixing unit fixed to the guiding unit for fixing the driver box to the installation plate, wherein the light escape is manually adjustable to select an escape diameter of the light escape from multiple diameter options for fitting to an opening diameter of the light opening of the light device, wherein the multiple diameter options correspond to multiple concentric geometric rings with different ring diameters.

2. The light platform apparatus of claim 1, wherein the guiding unit has a warped part, a buckle part, a main body plate and a connecting part, the warped part engages the fixing unit and moves for allowing the fixing unit entering a hook area, when the fixing unit enters the hook area, the fixing unit is kept at the hook area by the buckle part and the main body plate, the buckle part and the main body plate together form the hook area, the connecting part is fixed to the installation plate.

3. The light platform apparatus of claim 2, wherein the fixing unit have a first fixing part and a second fixing part attached on two opposite sides of the driver box.

4. The light platform apparatus of claim 3, wherein the fixing unit having a protruding block protruding from a flat plate, the protruding block is kept in the hook area clipping by the buckle part and the main body plate.

5. The light platform apparatus of claim 3, further comprising two fixing blocks on two sides of the connecting part for preventing the guiding unit to rotate from the connecting part.

6. The light platform apparatus of claim 1, wherein the installation plate has a main body plate and an adjusting folding plate, the adjusting folding plate is foldable to change a horizontal length of the installation plate to fit to a different installation gap.

7. The light platform apparatus of claim 6, wherein there are multiple options for folding the adjusting plate with different horizontal lengths of the installation plate.

8. The light platform apparatus of claim 6, wherein the adjusting folding plate is fixed to a vertical wall surface.

9. The light platform apparatus of claim 8, wherein the adjusting folding plate has a hook structure hooking to an associated fastener fixed on the vertical wall.

10. The light platform apparatus of claim 6, wherein there are multiple folding holes disposed between the main body plate and the adjusting folding plate.

11. The light platform apparatus of claim 6, wherein a protruding bottom edge is extended outwardly from a connection position between the main body plate and the adjusting folding plate, the protruding bottom edge is perpendicularly disposed with respect to the adjusting folding plate.

12. The light platform apparatus of claim 6, wherein in a first installation mode, the main body plate is co-plane with the adjusting folding plate to be installed, and in a second installation mode, the main body plate is perpendicular to the adjusting folding plate to be installed.

13. The light platform apparatus of claim 1, wherein a conductive path is disposed on the installation plate for electrically connecting the light device and the driver box.

14. The light platform apparatus of claim 13, wherein the conductive path of the installation plate is connected to a terminal connecting to another installation plate for sharing electricity from the driver box to the another installation plate.

15. The light platform apparatus of claim 13, wherein the installation plate has multiple function module slots for inserting function modules getting power from the driver box.

16. The light platform apparatus of claim 13, further comprising a buckling structure for fixing the light device on the installation plate, the buckling structure providing an electric connection to the driver box.

17. The light platform apparatus of claim 1, wherein the installation plate is made of a metal plate stamping for producing a main body plate and an adjusting folding part, the adjusting folding part is foldable with respect to the main body plate to change a horizontal length of the installation plate.

18. The light platform apparatus of claim 1, wherein the light device transmits heat to the installation plate with a heat dissipation strip heat conductive to a first heat dissipation area of the installation plate, the first heat dissipation area is heat insulated from a second heat dissipation area of the installation plate for dissipating heat of the driver box.

* * * * *